United States Patent [19]

Herbert

[11] 4,111,148

[45] Sep. 5, 1978

[54] APPARATUS FACILITATING REMOVAL OF A KORT RUDDER RING ON A MARINE VESSEL

[76] Inventor: Colin Wray Herbert, 44 High Street, Stokesley, Tees-side, North Yorkshire, England

[21] Appl. No.: 813,766

[22] Filed: Jul. 7, 1977

Related U.S. Application Data

[63] Continuation of Ser. No. 682,903, May 4, 1976, abandoned.

[30] Foreign Application Priority Data

May 5, 1975 [GB] United Kingdom ..... 18671/75

[51] Int. Cl.[2] ..... B63H 23/32

[52] U.S. Cl. ..... 115/76; 114/65 R; 115/42

[58] Field of Search ..... 114/166, 65 R; 115/42, 115/76; 416/208

[56] References Cited

U.S. PATENT DOCUMENTS

| | | | |
|---|---|---|---|
| 1,634,329 | 7/1927 | Malm | 416/208 |
| 2,139,594 | 12/1938 | Kort | 115/42 |
| 2,446,229 | 8/1948 | House | 115/42 |
| 2,800,150 | 7/1957 | Farwell, Sr. | 115/42 |

FOREIGN PATENT DOCUMENTS

| | | | |
|---|---|---|---|
| 1,023,689 | 1/1958 | Fed. Rep. of Germany | 114/166 |
| 974 of | 1872 | United Kingdom | 114/166 |

*Primary Examiner*—Stephen G. Kunin
*Assistant Examiner*—Stuart Goldstein
*Attorney, Agent, or Firm*—Burns, Doane, Swecker & Mathis

[57] ABSTRACT

This invention is an arrangement for easily removing a kort rudder ring from the hull of an oil drilling rig for examination of the bearings from time to time. The housing of the lower rudder ring pintle bearing is quickly removable from the outside by a diver, so that the ring can be dropped from its upper bearing housing, moved rearwardly, and lifted by lifting tackle to the surface. Thus examination can take place while the rig is still working at sea.

5 Claims, 5 Drawing Figures

APPARATUS FACILITATING REMOVAL OF A KORT RUDDER RING ON A MARINE VESSEL

This is a continuation, of application Ser. No. 682,903 filed May 4, 1976 now abandoned.

This invention relates to propulsion units for marine vessels for example, offshore drilling rigs.

Normal sterngear maintenance or inspection of seals, bearings, propeller and propeller shafts can be carried out at sea with assemblies referred to as "GLACIER-HERBERT" (Registered Trade Mark) and covered in British Patents Nos. 1,182,611, 1,182,612 and 1,182,613. Contrary to normal shipping practice, the sterngear of a self-propelled semi-submersible oil drilling rig may remain static for long periods and its condition is similar to that of a seasonally employed ship in so far as marine growth and corrosion are concerned, which is worse than a frequently operating vessel. Attention to steering or rudder bearings, the propeller and its shaft, the bearings and seals in the case of a normal ship even though seasonally employed is readily accomplished by dry docking or if a Glacier-Herbet sterngear arrangement is used by adopting maintenance procedures at sea as referred to in British Patents Nos. 1,182,611, 1,182,612 and 1,182,613. Semi-submersible oil drilling rigs are more or less undockable, and if normal sterngear is employed, the best that could be done would be to tip the rig to expose as much of the stern as possible which requires a sheltered location; alternatively the oil drilling rig could be beached on a flat sand bar in a sheltered area. The problem is further aggravated if the semi-submersible oil drilling rigs uses a pivoted Kort annular steering nozzle or rudder ring shrouding the propeller instead of the more conventional rudder.

An object of the invention is to simplify the arrangement for enabling the rudder ring journal bearings to be examined from time to time.

According to the present invention a marine vessel propulsion unit comprises a propeller within a Kort rudder ring having upper and lower vertical journal bearings in which the lower bearing is located in relation to the vessel hull by a housing which is removable from the hull.

Conveniently the housing is removable by withdrawal of clearance bolts and location is provided by dowels. It is probable that the bolts will have to be removed from the outside so that divers will be needed, but the arrangement described makes their task as simple as possible. Once the housing has been removed the rudder ring can also be removed and lifted up through lifting tackle either to the deck or a floating derrick for examination.

In one form of the invention a half housing is removable in a direction parallel with the propeller axis and away from the hull so that the lower journal can be moved out of the other half housing in the same direction. It may then be necessary to make the upper journal disconnectable from the ring so that the ring can be removed with the lower journal leaving the upper journal in its bearing.

Alternatively the housing may be removable vertically downwards from the hull and from the journal and then the rudder ring can be dropped so that the upper journal comes out of its housing for subsequent aft movement and lifting to the surface possibly after one or more propeller blades have been removed.

The invention includes a method of inspecting the bearings of a Kort rudder ring on a marine vessel propulsion unit in which a housing for the lower vertical journal bearing of the rudder ring is removed from the hull and then the rudder ring is removed from the hull and lifted to the surface for examination. Removal of the housing from the hull and the suspension of removed components by lifting tackle is preferably performed by a diver.

The invention may be carried into practice in various ways and two embodiments will be described by way of example with reference to the accompanying drawings in which.

Figure 1:
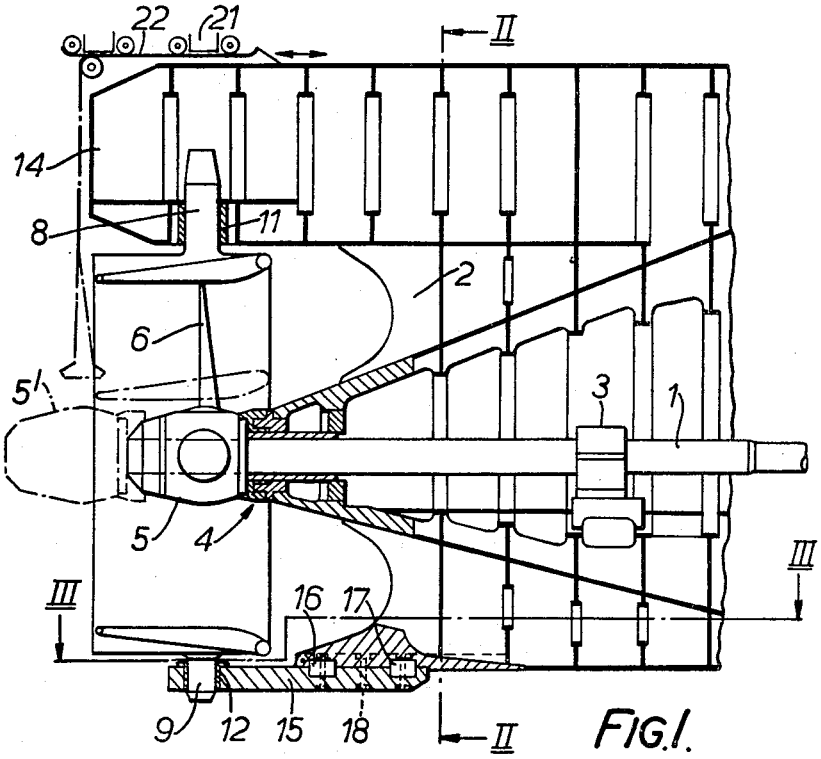
FIG. 1 is a vertical sectional elevation through the aft end of a stern tube arrangement for the propeller shaft of a self propelled off-shore drilling rig.
Figure 2:
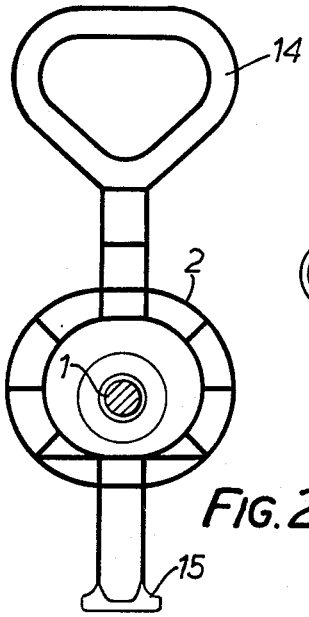
FIG. 2 is a vertical section on the line II—II in FIG. 1.
Figure 3:
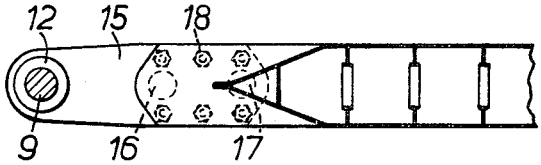
FIG. 3 is a view on the line III—III in FIG. 1.

The propeller shaft 1 is of uniform diameter through the after part of its length, and extends horizontally within a stern tube mounting 2 on the hull in a main plain journal bearing 3 and an external seal 4 to a propeller boss 5 externally of the tube 2 having four blades 6 each of which is removable from the boss.

The propeller rotates within a cylindrical shroud 7 constituting a Kort rudder which achieves steering by controlled pivoting about a vertical axis defined by upper and lower vertical journals 8 and 9 in plain bearings 11 and 12 which are fixed in relation to the tube mounting 2.

It is a requirement that periodically the journals must be examined for wear, and it is desirable that that examination can be made without having to go into dry dock.

Accordingly a flange on the fore end of the shaft is unbolted from its driving coupling, and the propeller shaft and propeller boss 5 are moved rearwardly through the bearing 3 and seal 4 to the position shown in chain lines at 5' in FIG. 1 in which the propeller blades 6 are clear of the aft end of the Kort rudder 7. The upper blade 6 is disconnected from the boss 5 and lifted clear of the boss using lifting tackle on the tail boom 14 extending rearwardly above the Kort rudder 7. The shaft is rotated through 90° internally and a second blade removed in the same manner. The shaft is then rotated 45° in the opposite direction so that the two remaining blades on the boss are symmetrically disposed on either side of a vertical plane in the lower part of the ring 7, and the propeller and shaft are hauled back to the original position.

The lower bearing 12 for the journal 9 is carried in a housing constituted by a rearwardly extending beam 15 secured to the stern tube mounting 2 through a pair of large locating dowels 16 and 17 and six clearance bolts 18.

A diver can remove the bolts and let the beam drop from its locating dowels after it has been supported from the stern tube 2 through a cable on a lifting lug at its point of balance. The journal bearing 12 is lowered clear of the lower journal 9 and lifted up over the side of the upper boom 14 with the lifting tackle so that the bearing can be examined.

The Kort rudder ring 7 has port and starboard lugs on its outer periphery and these are connected through cables to a yoke 21 which can run on a short rail 22 above the boom 14 so that after the control connections to the rudder ring have been dismantled, the rudder can be lowered until the top journal 8 is clear of its bearing 11 with the upper part of the ring clear of the propeller boss 5. Then the yoke 21 is moved aft along the track 22 until it is clear of the hull so that it can be lifted onto a suitable temporary platform on the tail boom 14 where the bearing surfaces can be examined.

The work that necessitates divers, namely the removal of the propeller blades, the removal of the beam 15 and the connection of the various components to the lifting tackle is reduced to a minimum, and the rig does not have to be beached or indeed does not have to be taken out of service while these bearing surfaces are examined, and if necessary repaired or replaced.

Figure 4:
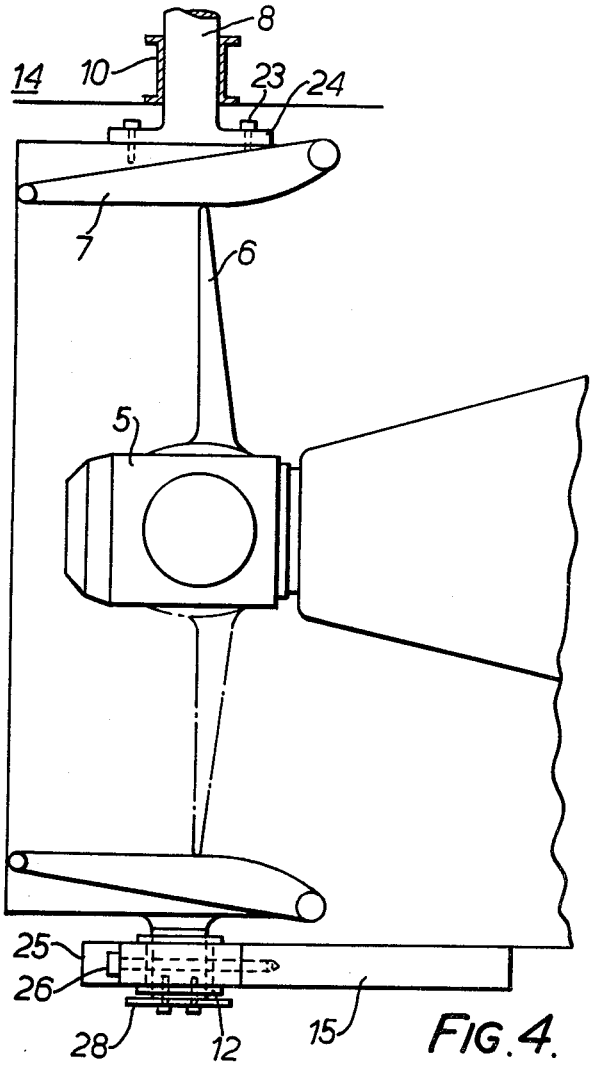
FIG. 4 is a sketch corresponding to FIG. 1 of an alternative arrangement.
Figure 5:
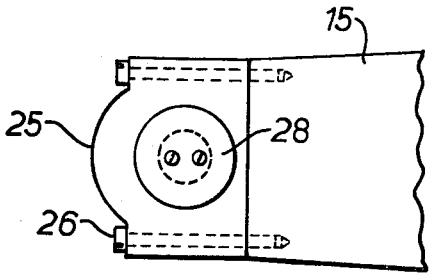
FIG. 5 is an underneath view of the arrangement of FIG. 4.

In the modification shown in FIGS. 4 and 5 the Kort ring 7 is connected to the upper journal 8 through bolts 23 in an external flange 24. Access to the bolt heads can be obtained through openings which can be uncovered in the tail boom 14 so that the ring does not have to be dropped to enable the journal 8 to be removed from its bearing 11.

At the lower end, the bearing 12 is held in a split housing, the aft half 25 of which can be removed after removal of bolts 26 by a diver.

Then the ring 7 can be slid aft without first being lowered, but otherwise in a manner described above and can be lifted for examination. It will be observed that there is a plate 28 on the lower end of the lower journal 9 which prevents the lower journal bearing 12 from dropping from the journal when the rear half component 25 of the housing has been removed and the Kort rudder has been slid aft.

In that arrangement it is not necessary to slide the propellar shaft 1 rearwardly.

I claim:

1. A propulsion unit for a marine vessel, comprising a hull supporting upper and lower vertical bearings at its aft end;

a drive shaft extending in a horizontal straight line from within said hull;

propeller blades individually removably mounted on said shaft outside said hull;

a Kort rudder ring surrounding said propeller and carrying upper and lower vertical journals mounted for rotation in said upper and lower bearings, respectively, and a housing containing said lower bearing, said housing connected to said hull by removable means enabling said housing and said lower bearing to be lowered directly from said hull and said lower journal, said housing extending forwardly beyond the forward end of said Kort rudder ring so that in response to removal of said housing and at least some of said blades, said upper journal is downwardly slidable from said upper bearing so as to permit downward removal of said Kort rudder ring from said hull for inspection of said upper and lower journals.

2. A marine vessel propulsion unit as claimed in claim 1 wherein said means for removing the housing from the hull is constituted by removable bolts.

3. A marine vessel propulsion unit as claimed in claim 2 in which the bolts have heads positioned externally of the hull.

4. A marine vessel propulsion unit as claimed in claim 2 in which the bolts hold the housing against downward movement from the hull and from its journal.

5. A marine propulsion unit as claimed in claim 1 including lifting tackle on the hull above the rudder ring for lifting removed components to the surface.

* * * * *